United States Patent [19]

Vogeli et al.

[11] Patent Number: 4,790,036

[45] Date of Patent: Dec. 13, 1988

[54] METHOD AND DEVICE FOR THE AUTOMATIC CLEANING OF A TOILET SEAT

[75] Inventors: Ernst Vogeli, Zurich; Jean-Jacques Asper, Croix-de-Rozon; Erwin Zurcher, Le Lignon, all of Switzerland; Erika Schnyder, Im Grubi, FL-9497, Triesenberg, Liechtenstein

[73] Assignee: Erika Schnyder, Triesenberg, Liechtenstein

[21] Appl. No.: 923,445

[22] Filed: Oct. 7, 1986

[30] Foreign Application Priority Data

Oct. 14, 1985 [CH] Switzerland ..... 04427/85
Oct. 14, 1985 [CH] Switzerland ..... 04446/85

[51] Int. Cl.[4] ..... A47K 13/00
[52] U.S. Cl. ..... 4/233; 4/237
[58] Field of Search ..... 4/233, 234, 237

[56] References Cited

U.S. PATENT DOCUMENTS

| | | | |
|---|---|---|---|
| 996,906 | 7/1911 | Blanchard | 4/214 |
| 2,603,797 | 7/1952 | Baither | 4/214 |
| 3,599,246 | 8/1971 | Bramati | 4/233 |
| 3,837,018 | 9/1974 | Haberle | 4/233 |
| 4,520,516 | 6/1985 | Parsons | 4/623 |
| 4,536,899 | 8/1985 | Schnyder | 4/237 |

FOREIGN PATENT DOCUMENTS

| | | | |
|---|---|---|---|
| 52034 | 2/1912 | Austria | 4/233 |
| 510241 | 10/1930 | Fed. Rep. of Germany | 4/233 |
| 2809622 | 9/1979 | Fed. Rep. of Germany | 4/234 |
| 83870 | 7/1935 | Sweden | 4/233 |
| 597446 | 4/1978 | Switzerland | 4/233 |
| 23676 | of 1911 | United Kingdom | 4/233 |

*Primary Examiner*—Henry J. Recla
*Assistant Examiner*—Linda J. Sholl
*Attorney, Agent, or Firm*—Armstrong, Nikaido, Marmelstein & Kubovcik

[57] ABSTRACT

A toilet seat (27) is provided with a slide housing (26) comprising nozzles for spraying and/or applying water and/or disinfecting liquid. It comprises at least one wiper for drying the surface of the seat (27). The slide housing (26) is placed over a segment of the seat (27), which then, while being sprayed by the nozzles, is driven in the circumferential direction by at least one electric motor. The entire operation is started up manually by actuating the lever (2) of the flushing water cistern (1), and subsequently is controlled by the control electronics (27) until the cleaning of the seat (27) has been completed. The energy is obtained by a turbine (11), which is mechanically connected to a low-voltage direct-current generator (13), and is driven by the water filling the flushing water cistern (11). The actual flushing water, therefore, flows at the normal kinetic energy into the toilet; the hydraulic resistance of the turbine (11) is not switched on while the flushing water flows into the toilet bowl. The device is extremely reliable, does not carry any dangerous electric voltages, and in addition contains safety measures which prevent possible injuries, in particular of children. It is suitable for use with new installations, as well as for adaptation to already existing toilets.

21 Claims, 6 Drawing Sheets

METHOD AND DEVICE FOR THE AUTOMATIC CLEANING OF A TOILET SEAT

BACKGROUND OF THE INVENTION

Field of the Invention:

The present invention relates to a method for the automatic cleaning of a toilet seat, wherein the seat of the toilet, during the cleaning, is moved in a circumferential direction, and is cleaned with water and/or a disinfecting liquid, and to a device for performing the method.

Description of the Prior Art:

Methods and devices of the above-mentioned type are already known; thus, for example, the EP-B1-No. 0 035 962 describes and illustrates a toilet with flushing device and self-cleaning toilet seat. A segment of the seat is engaged in a transport and cleaning element. This element comprises nozzles for cleaning with water and a disinfecting liquid, and includes a wiper for drying the surface. This element, therefore, also engages the seat when the device is not in use. The rotating of the seat required for the cleaning is ensured by means of a water wheel, the flow of the flushing water being used to drive it. The seat is positioned between at least one support roller and at least one drive roller arranged underneath the seat. This device is functional, but has the disadvantage that the transport and cleaning element also engages the rear segment of the toilet seat when the device is not in use, which could render the use of the toilet uncomfortable.

SUMMARY OF THE INVENTION

It is the object of the present invention to eliminate the disadvantages of the prior art, and to create a method and device for the automatic cleaning of a toilet seat, which do not have the disadvantages of the prior art, and which, when the device is not in use, leave the surface of the seat free from parts which clean, and possibly move it.

With a method of the type mentioned at the outset, this object is achieved in that a slide housing comprising units for the wetting with water and/or the disinfecting liquid and a drying unit, is moved from a neutral position outside the seat into a position above a segment of the ring-shaped seat, in that subsequently the water and/or the disinfecting liquid is fed in and applied to the seat, and in that the seat is rotated by at least 360°, the upper surface of the seat being dried.

The advantage of this method, is that in the neutral position of the device the entire seat is free, and only after the slide housing with the wetting devices and at least one wiper is placed on a segment of the seat, is the seat able to rotate, during which rotation it is washed, possibly also disinfected and dried. When the cleaning has been completed, the slide housing is again pulled back to a position adjacent the surface of the seat.

In the simplest case, the seat is rotated by only 360°, during which it is sprayed or wetted and at the same time dried by at least one wiper. It is also possible to rotate the seat twice through an angle of rotation of 360°, when during the first rotation the spraying or the wetting with the liquids takes place, and during the second rotation the drying. This is, in particular, expedient in most countries where the seat has an oval shape. In the USA, for example, more and more circular seats are being used. In this case, of course, the rotation need not be only 360°, since the neutral position may be any.

One could, for example, use a rotation of 400°, so that the most highly stressed part of the surface of the seat moves during the various rotations in the circumferential direction of the seat. In this case, for example, the spraying and the wetting with the liquids could take place during the rotation by 360°, whereas during the remaining 40° only the drying is still in operation. In this way it could be prevented that the zero position under the slide housing becomes wetter than the other parts.

It is, furthermore, advantageous when during the moving forward of the slide housing at least one valve for spraying the water and/or the disinfecting liquid is opened by means of at least one moving part, and is kept open while the device is in the forward operating position. This technical solution has the advantage that one or two valves are automatically mechanically actuated by the movement of the slide housing, e.g. by means of parallel swivel arms which carry the slide housing.

According to a further development, the slide housing and the seat are driven by electric motors. This solution is extremely economical since in this case no complicated mechanical drive is required; the required electric motors can be series-produced, which also renders this solution economical.

It is expedient when the electrical energy for driving the electric motors and control electronics is obtained by means of a turbine, which is driven by the water flowing into the flushing water cistern after a valve of a float has opened, and which turbine mechanically drives a power generator. This further development has several advantages. No outside energy is required, e.g. from the power mains, although it is possible, of course, in particular in the case of new installations and when a low-voltage source is already available for other reasons, to use this source directly without the aformentioned turbine and the aforementioned generator. A further advantage can be seen in that the functioning of the turbine and, therefore, of the power generator is linked directly only to the filling up again of the flushing water cistern, so that the kinetic flushing energy of the flushing water is not reduced.

It is particularly expedient when individual operating stages are started up manually by means of a lever of the flushing water cistern, and thereafter are controlled automatically by the control electronics. In this way the cleaning takes place only when the lever of the flushing water cistern is pressed by hand, i.e. when the toilet is no longer in use. In this way the starting up of the operating stages is also not dependent on the removal of pressure from the seat, although in this connection additional safety measures are provided.

According to a variant, also the valves for feeding-in the cleaning water and/or the disinfecting liquid are controlled by the control electronics. This variant can replace the already previously described solution with which the valves are controlled mechanically by at least one moving part. It is up to the design engineer to choose which of the described solutions is used.

It is, furthermore, advantageous when the control electronics are informed of the position of the seat by means of a contract arrangement. It is expedient to use two pairs of contacts which signal the position of the seat. They inform the electronics whether the seat is occupied or already raised or unoccupied. Most toilet seats are not circular, but are elliptical at least in the inside diameter. With this seat shape it is also important that after the circumferential movement the seat moves back into the so-called zero position, i.e. the narrow parts of the seat are in the front and at the rear. This increases the safety of the method, and prevents the user, in particular a child, from being injured.

To dry the seat, the seat is wiped during the rotating movement of the seat and the moving backwards of the slide housing, by at least one radially extending wiper and at least one wiper which extends in the circumferential direction of the seat. It was found, in view of the fact that only a small quantity is needed to wet the surface of the seat, and that as a disinfecting liquid a fast-drying liquid can be used, one radially extending wiper suffices to adequately dry the surface of the seat.

It is preferable that the wiper which extends in the circumferential direction of the seat is fastened to a tiltable lever, which by means of a solenoid is held in the top, non-operative position, and during the backward movement of the slide housing is lowered onto the seat and wipes it. In this way it is ensured that the wiper is lowered only shortly before the slide housing moves back, and that it then with sufficient pressure dries any moisture marks that may still be present on the surface of the seat.

According to another variant, the surface of the seat is dried by a current of air. This variant is particularly advantageous in conjuntion with already existing hygiene devices in toilets, which comprise a source for a current of air or hot air.

The device for performing the method is expediently designed such that the slide housing is positioned slidingly on slide rails and is pulled outwards by a helical spring. This design enables the device to also be used without problems for elliptical seat shapes.

The slide housing is expediently provided with support rollers. These support rollers have vertical axes and with their circumferential surfaces support the inner profile of the seat. In this way th slide housing follows this profile, the slide housing being pulled outwards by the helical spring, as mentioned in the foregoing, thus ensuring the contact of the support rollers with the seat.

The source of the disinfecting liquid is in the form of a tank in which the disinfecting liquid is kept under gas pressure. For this one way, of course, use one of the known propellant gases which are not harmful to the environment, or the closure of the tank may be in the form of a known pump valve which in the known manner ensures, during the cleaning, an adequate air pressure above the disinfecting liquid. It is also possible for the flow of liquid to reach the places to be disinfected at the given time by gravitational force, due to the difference in levels.

To faciliate the rotating of the seat during the cleaning, the seat rests on steel balls which are inserted rotatably in a compressable elastic ring. In this simple manner, when the seat is not occupied it can with little force be rotated in the circumferential direction, whereas the occupied seat rests on hard parts which due to the friction force prevent a possible rotating.

According to an advantageous further development, the slide housing is fitted with a wetting element which comprises a sponge insert which is provided with a material cover, and serves to wet the seat with the disinfecting liquid. This solution is particularly suitable for fast-drying disinfecting liquidjs, in which case the desired surface of the seat is wetted properly with the disinfecting liquid.

The electric circuit is preferably designed such that the electric motor for driving the slide housing is connected to the energy source by way of a forward logic, a backward logic and by way of two power stages.

It is advantageous when the power stages contain substages for the full power and sub-stages for a reduced power of the electric motor. In this way the motor is supplied with the correct, i.e. not too great and not too low energy, so that on the one hand the correct and fault-free movement of the slide housing is ensured, and on the other hand the movement is controlled with only minimal force so as not to cause any injuries, in particular in the case of children.

According to a favorable embodiment, the at least one electric motor for driving the seat is connected to the energy source via a control logic and an amplifier stage. Also this measure ensures that only the required energy is supplied.

According to an advantageous further development, the electric circuit comprises two memories which record the position of the safety switches and the information of the time element. The safety switches signal the position of the seat and prevent a possible incorrect functioning of the cleaning arrangement.

It is advantageous if an end position monitoring circuit comprises three function units, of which the first unit is connected to the forward logic, the memory as well as to a time element, the second unit to the backward logic, and finally the third unit on the one hand to the control logic for the electric motors rotating the seat, and on the other hand, via a time element and an amplifier stage, to a standard-coil solenoid. The three function units preferably monitor the three different movements, ie. the forward, and the backward movement of the slide housing and the rotating movement of the seat.

Accordingly, in order to achieve the above-noted objects of the invention, the present invention provides a method for the automatic cleaning of a substantially ring-shaped toilet seat, said method comprising the steps of:

providing a toilet bowl operably connected to a flush water cistern, said toilel bowl having a substantially ringshaped toilet seat rotatably mounted thereon, said toilet seat being rotatable in a circumferential direction, said flush water cistern being connected to a water inlet pipe, said water inlet pipe provided with a first valve means for controlling the flow of water through said water inlet pipe to maintain a predetermined water level in said flush water cistern, said toilet bowl operably connected to said flush water cistern through a lever-actuated second valve means for controlling the flow of water from said flush water cistern to said toilet bowl, said lever-actuated second valve means including a manually actuable lever movable between a valve closed position and a valve open position;

providing a slide housing means for movement between a neutral position adjacent said toilet seat and an operative position disposed above a segment of said toilet seat, said slide housing means including spray means for applying a cleaning liquid to said toilet seat when said slide housing means is in said operative position and drying means for drying said toilet seat after application of said cleaning liquid;

providing first motor means, responsive to a first power input, for moving said slide housing means between said neutral position and said operative position;

providing second motor means, responsive to a second power input, for rotating said toilet seat in said circumferential direction;

providing a power supply means, responsive to actuation of said manually actuable lever, for providing power to said first motor means and said second motor means;

providing control electronics means, operably connected to said first motor means, said second motor means and said power supply means, for controlling the distribution of power from said power supply means to said first motor means and said second motor means;

moving said manually actuable lever from said valve closed position to said valve open position whereby said water in said flush water cistern is released into said toilet bowl and said first valve means opens to allow water to flow into said flush water cistern through said water inlet pipe and said power supply means provdes power and said control electronics means automatically causes said first motor means to move said slide housing means into said operative position and said spray means applies said cleaning liquid to said toilet seat, while also causing said second motor means to rotate said toilet seat through at least 360° while said drying means dries said toilet seat after application of said cleaning liquid.

In a further aspect, the present invention provides a toilet with an automatically cleanable toilet seat comprising:

a toilet bowl; a flush water cistern;

a substantially ring-shaped toilet seat, said toilet being rotatable in a circumferential direction;

mounting means for mounting said toilet seat on said toilet bowl for relative rotation therebetween in said circumferential direction;

a water inlet pipe, connected to said flush water cistern, for supplying water to said flush water cistern;

first valve means, connected to said water inlet pipe, for controlling the flow of water through said water inlet pipe to maintain a predetermined water level in said flush water cistern;

lever-actuated second valve means for fluidically connecting said toilet bowl and said flush water cistern and for controlling the flow of water from said flush water cistern to said toilet bowl, said leveractuated second valve means including a manually actuable lever movable between a valve closed position and a valve open position; a slide housing means for movement between a neutral position adjacent said toilet seat and an operative position disposed above a segment of said toilet seat, said slide housing means including spray means for applying a cleaning liquid to said toilet seat when said slide housing means is in said operative position and drying means for drying said toilet seat after application of said cleaning liquid;

first motor means, responsive to a power input, for moving said slide housing means between said neutral position and said operative position;

second motor means, responsive to a power input, for rotating said toilet seat in said circumferential direction, relative to said toilet bowl;

power supply means, responsive to actuation of said manually actuable lever, for providing power to said first motor means and said second motor means;

control electronics means, operably connected to said first motor means, said second motor means and said power supply means, for controlling the distribution of power from said power suppply means to said first motor means and said second motor means;

whereby upon movement of said manually actuable lever from said valve closed position to said valve open position, said water in said flush water cistern is released into said toilet bowl and said first valve means opens to allow water to flow into said flush water cistern through said water inlet pipe and said power supply means provides power to said control electronics means and said control electronics means causes said first motor means to move said slide housing means into said operative position and said spray means applies said cleaning liquid to said toilet seat, while also causing said second motor means to rotate said toilet seat through at least 360°0 while said drying means dries said toilet seat after application of said cleaning liquid.

BRIEF DESCRIPTION OF THE DRAWINGS

The invention will be explained in greater detail with reference to the drawings. In all drawings identical functional parts have been given the same reference numerals.

DETAILED DESCRIPTION OF THE INVENTION

Figure 1:
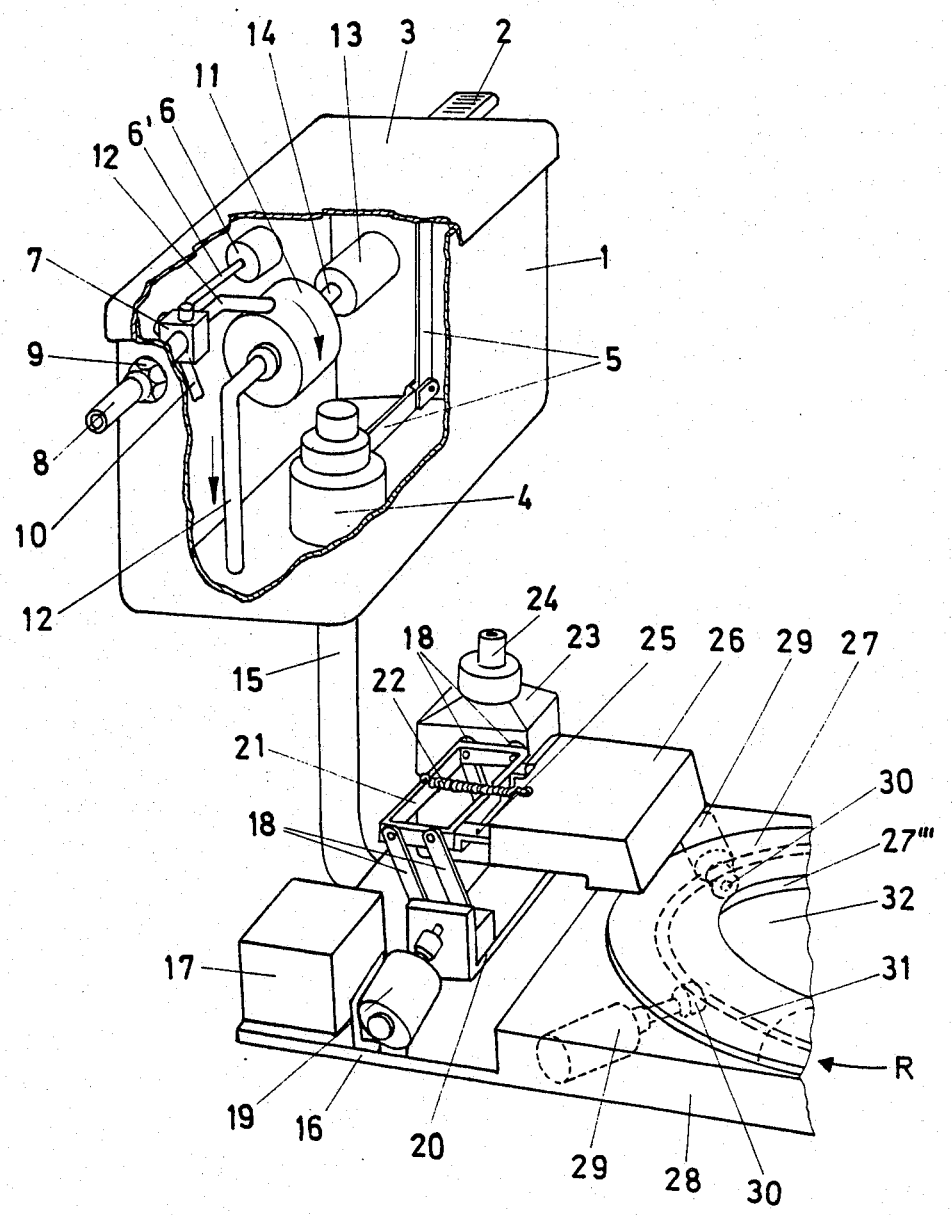
FIG. 1 shows a perspective view onto the arrangement according to the invention, with a partial sectional view of the rear part.

FIG. 1 shows, partialy in section, a flushing water cistern 1, provided with a lever 2 and a cover 3. Arranged inside the flusing water cistern 1 is a known flushing valve 4, which by way of a lever 5 is connected to the hand-operated lever 2 of the flushing water cistern 1. Provided inside the flushing water cistern 1 is a float 6, which by means of a lever 6' is connected to the valve 7. The valve 7 is connected to a water inlet pipe 8, which by means of a nut 9 is fixed into the wall of the flushing water cistern 1. In front of the valve 7, a pipe 10 for cleaning water is connected, so that this is always under water pressure. A water turbine 11 is connected by a feed pipe 12 to the valve 7. Through this feed pipe 12 and the water turbine 11, the flushing water cistern 1 is filled up again. A power generator 13, in this example a low-voltage direct-current generator, is mechanically connected to the water turbine 11 by a shaft 14. Connected to the flushing valve 4 is a flusing water pipe 15, which is used for the known flushing. Underneath the flushing water cistern 1, a mounting plate 16 is arranged in the horizontal position. Fastened onto this mounting plate 16 are, amongst others, the control electronics 17 in a housing. Parallel swivel arms 18 are driven by an electric motor 19, and are held rotatably in a holder 20. The outer ends of the parallel swivel arms 18 carry a frame 21, in which one end of a helical spring 22 is fastened. Also fastened on the mounting plate 16 is a tank 23 which holds disinfecting liquid. This tank is provided with a closure 24, which may possibly be in the form of a pump valve, in which case no propellant gas is required for the tank 23. Solidly connected to the frame 21 is a pair of slide rails 25. A slide housing 26 moves along these slide rails 25. The seat has been given the reference numeral 27. Provided on the mounting plate 16 is a protective housing 28, in which the drive and braking elements of the seat 27 are arranged, which will be described further on. Two electric motors 29 are provided to drive the seat 27. During the cleaning, the seat 27 moves in the direction R. The electric motors 29 are provided with gearwheels 30, which engage in a rack 31 provided circularly in the bottom surface of the seat 27. Underneath the seat 27, a known toilet bowl 32 is provided. It speaks for itself that the illustrated parts, such as the control electronics 17, the swivel arms 18, the frame 21, and the helical spring 22 including the tank 23, are covered by a non-illustrated housing, so as to prevent possible damage by vandalism or injuries to curious users.

Figure 2:
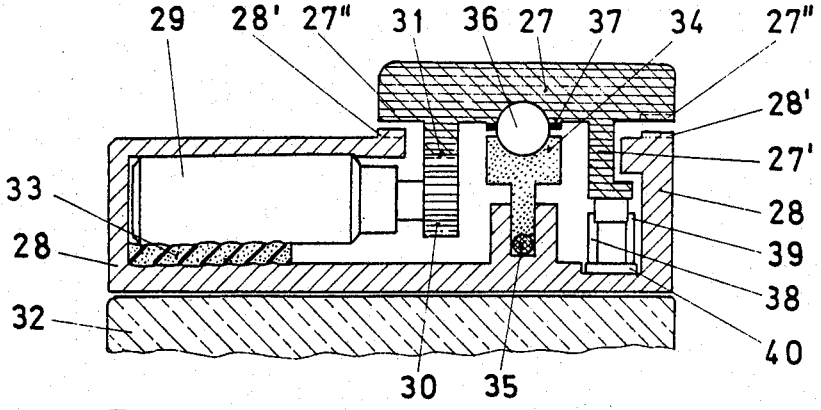
FIG. 2 shows a section through the seat with its support and its drive.

The section of FIG. 2 through part of the seat 27 and the electric motor 29, shows the drive and the fixing of the seat 27 in greater detail. The seat 27 has a widened part 27' and an annular contact strip 27''. The protective housing 28 is also provided with contact strips 28', which correspond to the contact strips 27'' of the seat 27, and, when the seat 27 is occupied, these contacts make contact with one another so as to prevent a possible rotating of the seat 27. FIG. 2 shows the seat when not occupied. This means that these contact strips 27'' and 28' are not in contact. The seat 27 is raised by an elastic ring 34, which in turn rests on a rubber ring 35. To facilitate the rotating of the seat 27, a number of steel balls are provided, which are held in a bearing ring 37. The electric motor 29 has an elastic support 33, which permits a tilting of the axis of the electric motor 29 when the seat 27 is occupied. This measure is necessary, since the seat 27 is driven by the gearwheel 30 of the electric motor 29 by way of the rack 31 in the bottom surface of the seat 27. Between the widened part 27' of the seat and the mounting 40 in the bottom part of the protective housing 28, two diagrammatically illustrated switches 38, 39 are provided, of which, for example, in the open position the top switch 38 signals the unoccupied position of the seat, and the bottom switch 39 the fact that the seat 27 has been tilted up.

Figure 3:
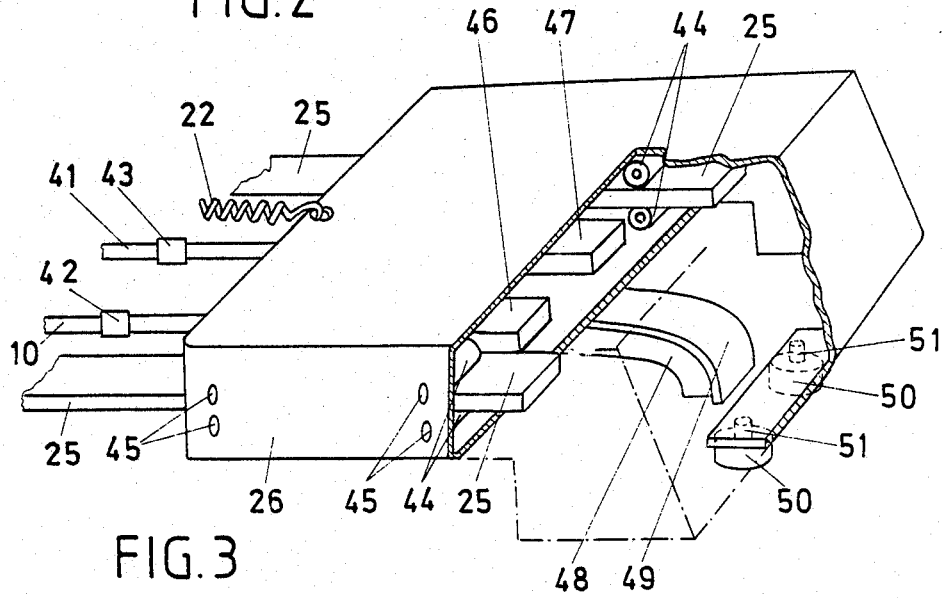
FIG. 3 shows a perspective view onto the slide housing with support rollers, partly in a sectional view.

According to FIG. 3, the pipe 41 of the disinfecting liquid is provided with a valve 43, and the pipe 10 of the cleaning water with a valve 42. The slide rails 25 are held in rollers 44 arranged in pairs. The rollers 44 are mounted rotatably on shafts 45, which are fastened in the side walls of the slide housing 26. A nozzle unit 46 is destined for spraying the water, and another nozzle unit 47 for spraying the disinfecting liquid. A wiper 48 is held in a carrier 49, which is connected to the slide housing 26. This mechanical wiper 48 may also be replaced by a drying air current or a current of hot air. This further possibility is expedient when an air current or hot current source is already provided in the toilet for another hygiene device. A wiper 48' extending in a direction perpendicular to the wiper 48 (FIG. 4) is also fastened in the slide housing 26 into the neutral position. In the bottom part of the slide housing 26 vertical-axis support rollers 50 are fastened, which during the rotating of the seat 27 are in contact with the inner edge of the seat 27'. The shafts of the support rollers 50 have been given the reference numeral 51.

Figure 4:
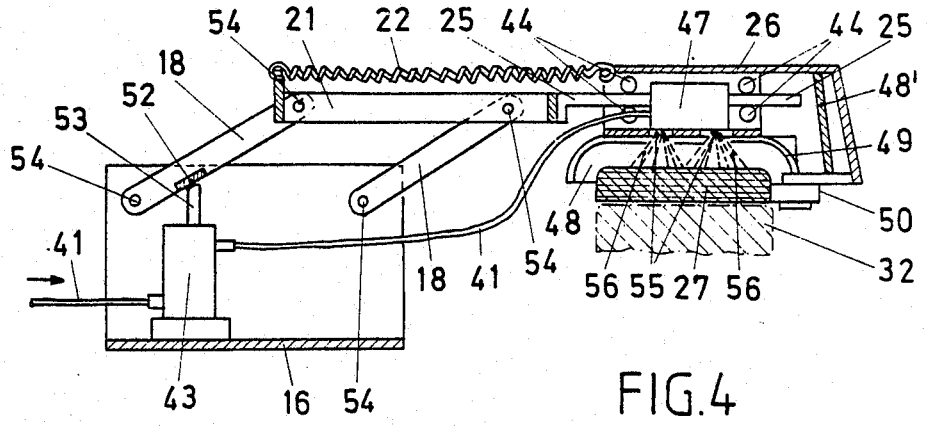
FIG. 4 shows a section through the slide housing of FIG. 3 with cleaning nozzle and other additional parts from FIG. 1.

FIG. 4 shows a section through the device according to the invention in the area of the cleaning agent. In a rear parallel swivel arm 18 a contact plate 52 is provided, which during the cleaning phases presses a control pin 53 downward, and by doing so opens the valve 43 for the disinfecting liquid. The other valve 42 for the cleaning water cannot be seen in this sectional view.

The parallel swivel arms 18 are mounted with the aid of rotating pins 54. The nozzle unit 47 for spraying the liquid comprises two nozzles 55, which spray two jets 56 of liquid.

Figure 5:
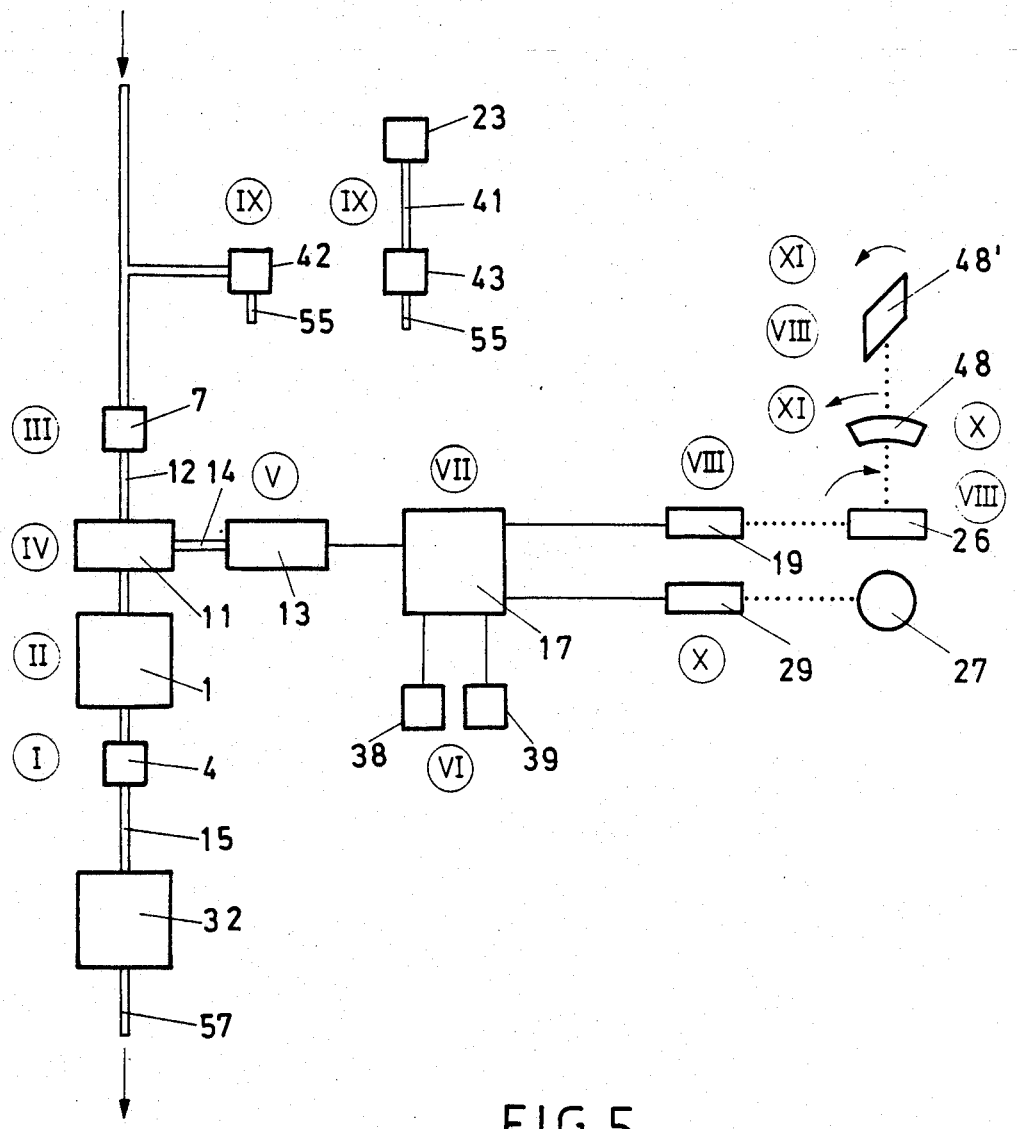
FIG. 5 is a diagrammatic overall view, in which the invidual operating stage I to XI of the cleaning method are shown.

The mode of functioning of the device will now be described in detail, with reference to FIGS. 5, as individual operating stages I to XI of the method. In FIG. 5 individual parts have been given the same reference numerals used in the foregoing. The only additional part shown is a drain 57 from the cistern 32.

Stage I By means of the lever 2 of the flushing water toilet bowl 1, the flushing valve 4 is opened, and water flows through the flushing water pipe 15 into the toilet bowl 32 and away through the drain 57.

Stage II The flushing water cistern 1 becomes empty, and the float 6 sinks downward.

Stage III The lever 6' of the float 6 now opens the valve 7, and water starts to flow into the flushing water cistern 1.

Stage IV The water flows through the feed pipe 12 and the turbine 11, which by way of the shaft 14 drives the low-voltage directcurrent generator.

Stage V The low-voltage direct-current generator 13 supplies the current for the control electronics 17.

Stage VI The contact pairs 38, 39 supply information to the control electronics 17 about the position of the seat.

Stage VII The control electronics 17 process the information from Stage VI and switch on the electric motor 19.

Stage VIII The electric motor 19 moves the slide housing 26 over a pair of the seat 27.

Stage IX When doing so, together with the slide housing, also the valves 42, 43 are actuated, and the water and/or the disinfecting liquid spray onto the surface of the seat 27.

Stage X The control electronics 17 switch on the electric motors 29, which drive the seat 27 in the direction of rotation R(see FIG. 1). During the rotating of the seat 27, also the wiper 48 is in operation and dries the surface of the seat 27.

Stage XI After the seat 27 has been rotated during the cleaning by 360°, the control electronics 17 pull the slide housing 26 backwards away from the seat 27, when the last part of the seat surface is dried by the second wiper 48'. At the same time also the two valves 42, 43 for the water and the disinfecting liquid are closed and the cleaning cycle has ended.

The throughflow profiles and the quantities of water are dimensioned such that water continues to flow through the valve 7, and therefore also through the turbine 11, also when the cleaning cycle has already ended. This does not mean, however, that the cleaning cycle automatically starts anew. Delay elements are provided in the control electronics, which prevent this.

The abovementioned operating stages refer to the example illustrated in the drawings, and within the framework of the invention may also be realized differently. The slide housing 26, instead of by parallel swivel arms 18, may also be guided in a link line. In the illustrated example of the parallel swivel arms 18, the holder 20 and the frame 21 form two parallelograms, so that the slide housing 26 moves in the same horizontal position and in a circular arc-shaped trajectory. In contrast thereto, the link line that may be used can determine any trajectory for the movement of the slide housing 26. Instead of the mechanical control of the valves 42, 43, also the electric control already mentioned in the foregoing may be used. It is also possible that the second wiper 48', extending in the circumferential direction of the seat 27, is not connected to the slide housing 26, but has a separate tiltable elastic carrier. It is also possible to use only one nozzle 55, which then is fed with water into which a disinfecting agent is mixed. In this case it is then possible to use the other line 41 as an air supply line and thereby dry the cleaning liquid from the seat by a blast of air through the remaining nozzles.

In the following, a preferred simplified embodiment is described of a variant of a furhter development of the device according to the invention. The same operational parts have again been given the same reference numerals.

Figure 6:
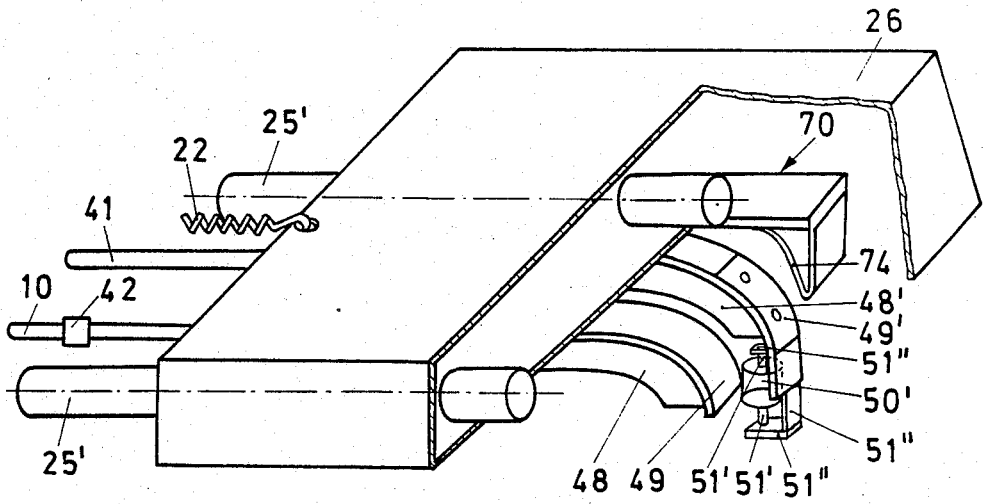
FIG. 6 is a variant of a slide housing developed further from that of FIG. 3, comprising a wetting element for the disinfecting.

The slide housing shown in FIG. 6 has a number of special features compared to that of FIG. 3. This housing slides on two round slide rails 25', in a cylinder which are also round. The cleaning water is again controlled by a valve 42 in the pipe 10. The pipe 41 of the disinfecting liquid is in the form of an overflow pipe, without valve, and is connected to the tank 23, which in this case is pressureless and contains the disinfecting liquid. In the front part facing the seat, under the cover of the slide housing 26, a first and second wiper 48, 48' are provided for the circumferential direction of the seat. They are again fastened to carriers, the second carrier 49' being extended downwards and in addition carrying a support roller 50'. This support roller 50' rests on shafts 51, 51' supported at their ends, which are fastened to the brackets 51'' attached to the carrier 49. In the rear part of the slide housing 26, a wetting element 70 is provided, which replaces the spraying device for the disinfecting liquid (FIG. 3, FIG. 4). This wetting element is supplied with disinfecting liquid from the pressureless tank 23 whenever the wetting element 70 is positioned at a lower level than the level of the liquid in the tank 23, i.e. in the cleaning and disinfecting position of the slide housing 26.

For the rest, the mechanical construction of the slide housing 26 corresponds to the solution of FIG. 3. The moving back of the slide housing into the neutral is again ensured by a helical spring 22.

Figure 7:
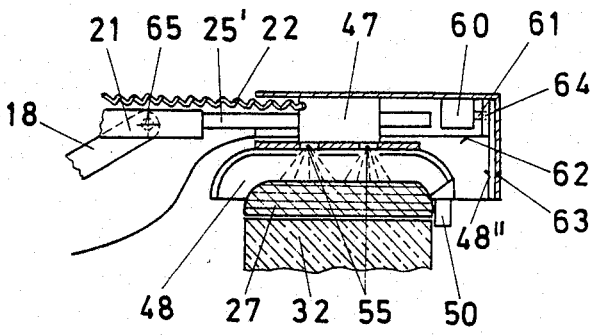
FIG. 7 is a section through the slide housing of FIG. 4, in addition with an electro-magnetically controlled wiper for the radial direction.

The other details, e.g. the nozzle unit 47 for spraying the cleaning water by means of two nozzles 55, which spray two jets of liquid, can be noted from the sectional view of FIG. 7.

Figure 10:
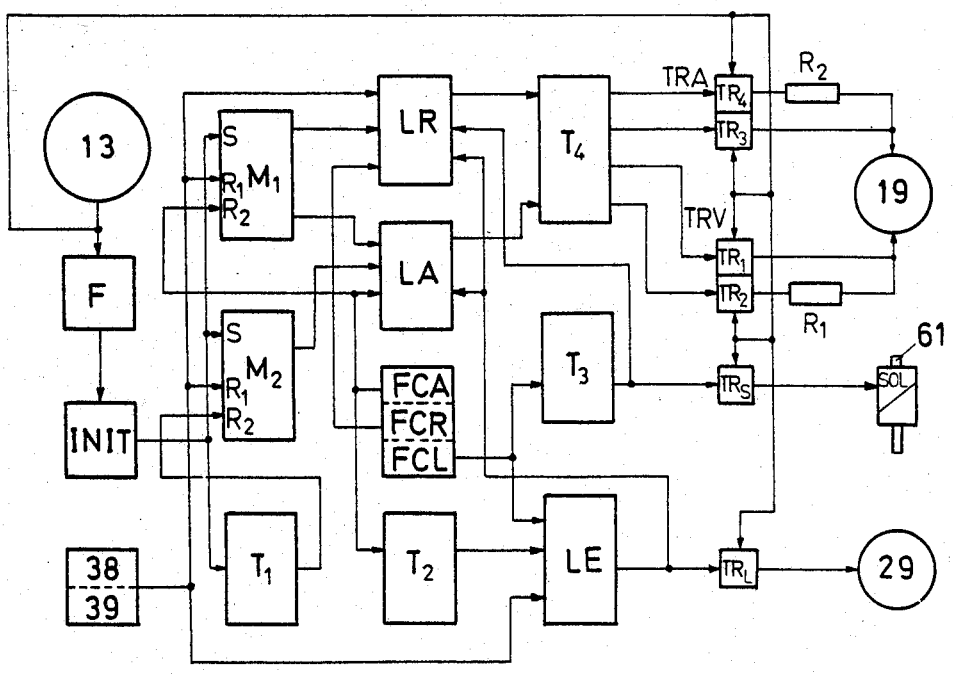
FIG. 10 shows the simplified circuit diagram of the electronic control of the overall device.
Figure 9:
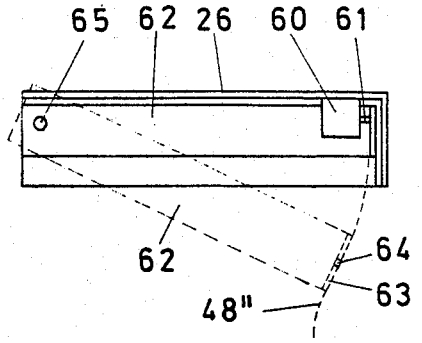
FIG. 9 shows details of the electro-magnetically controlled wiper for the radial direction, according to FIG. 7.

According to FIGS. 7 and 9, at the front of the slide housing 26 an electro-magnet 60 is provided, with a solenoid (SOL) which is not illustrated in these Figures and is controlled by the electronic circuit FIG. 10. The armature 61 of the electromagnet 60 in the neutral position holds a onesidely mounted lever 62, engaging into a bore 64 of its angle 63. At the end of the cleaning operation the solenoid (SOL) is briefly energized, so that the armature 61 pulls back, and due to gravity tilts the lever 62 downward around the axis of rotation 65. In the illustrated case a wiper 48'' is arranged at the end of the angle 63, which wiper rests on the seat and, during the backward movement of the slide housing 26 produced by the spring 22, wipes off the water marks left by the wipers (for the circumferential direction).

The lever 62 is arranged in the slide housing 26 in such a way that, in the neutral position of the housing 26, it is moved back mechanically into its starting position with locked armature 61. This mode of functioning can easily be noted from FIG. 9, in which broken lines illustrated the lever 62 with its angle 63, its bore 64 and the wiper 48'', in the downwardly tilted position.

Figure 8:
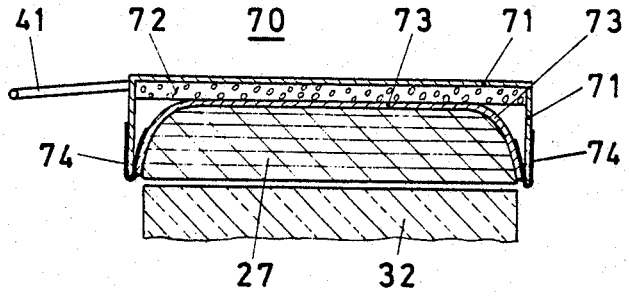
FIG. 8 is a longitudinal section through the wetting element of FIG. 6 with a section of the wetting seat.
Figure 8A:
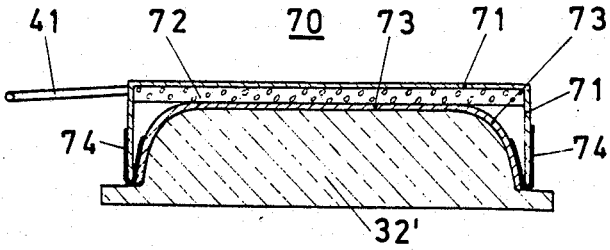
FIG. 8*a* is the same section through the wetting element, but in its rear neutral position which prevents the drying-out.

The wetting element 70, FIGS. 6,8,8*a*, consists of a light sheet-metal U-section 71, in which a sponge insert 72 is arranged, which—in the correct position—is supplied with disinfecting liquid through the pipe 41. This sponge insert 72 wets a material cover 73 of rough, snythetic cloth, which engages around the greater part of the seat 27 and disinfects it. At the edges the material cover 73 is provided with two tighteners 74 of a rubber band, thus ensuring at all times a form-locking contact with the seat 27 at a suitable contact pressure. FIG. 8*a* shows the wetting element 70 in its rear neutral position, where it is pressed onto a raised section 32' of the toilet bowl 32, thus substantially limiting the drying out of the sponge insert.

The material cover 73 with its two tighteners 74 can very easily be removed from the U-section 71; it is only pressed in so that, in the course of the normal toilet cleaning work, it can very easily be replaced.

Figure 11:
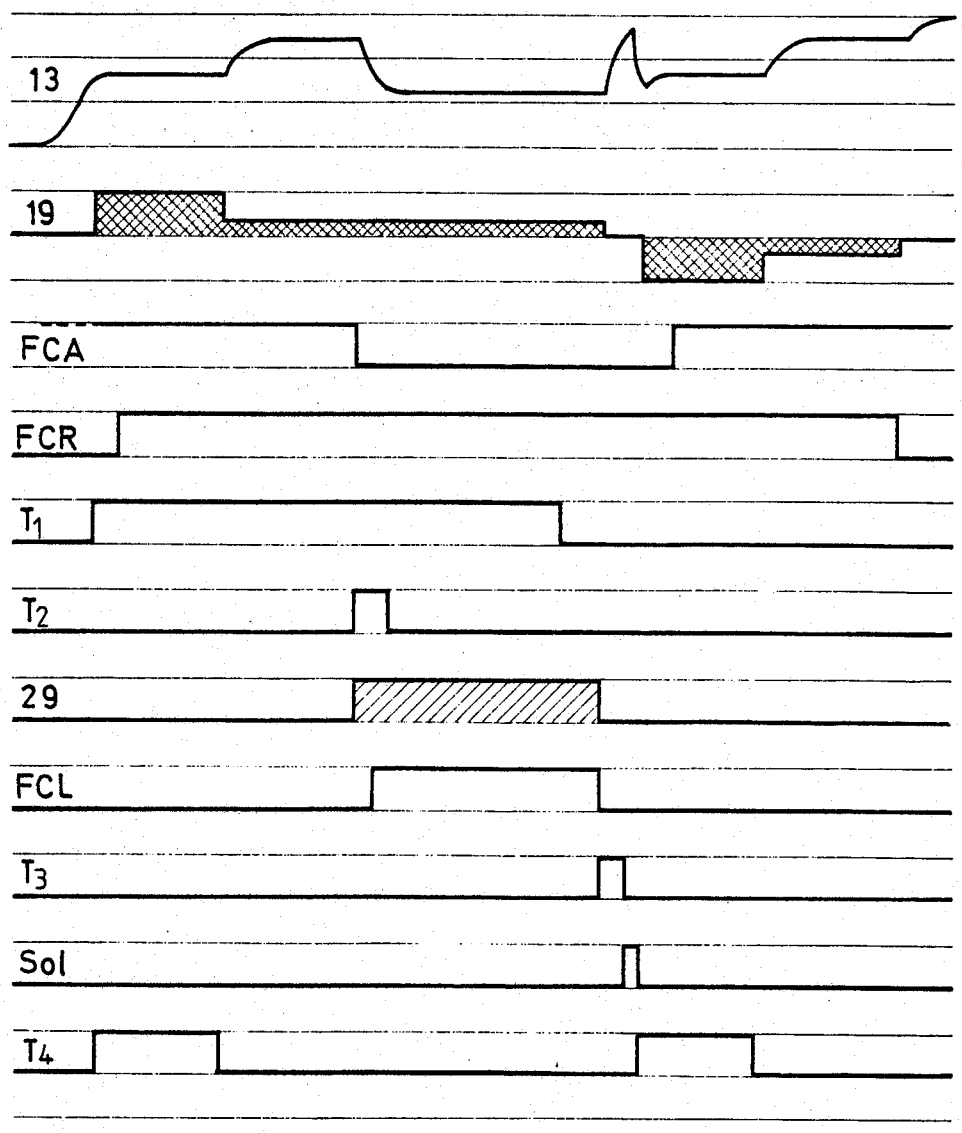
FIG. 11 shows a time/flow-chart of the realized device.

The interaction of the individual components of the device will be explained in greater detail with reference to FIG. 10 and 11.

In the block diagram of the electronic control shown in FIG. 10, the output of the low-voltage direct-current generator 13 is connected, by way of a filter F, to a trip circuit INIT. The output thereof is connected on the one hand to two memories $M_1$, $M_2$, and on the other hand to a time element $T_1$, the output of which is in turn connected to the memory $M_2$. One output each of the memories $M_1$, $M_2$ leads to a forward logic LA, which controls the electric motor 19 such that the slide housing 26 is moved forward, i.e. in the direction of the seat 27. The output of the memory $M_1$ furthermore leads to a backward logic LR, which moves the electric motor 19 in the opposite direction, i.e. away from the seat 27. The outputs of the forward and backward logic LA, LR are connected by way of a time element $T_4$ to two power stages TRA and TRV respectively, by way of which the generator 13 is switched on to selectively drive the electric motor 19 in the one or the other direction of rotation. The two power stages TRV and TRA each contain two substages $TR_1$, $TR_2$, and $TR_3$, $TR_4$ respectively. When the stages $TR_1$ and $TR_3$ are activated, full power is supplied to the electric motor 19, whereas when the stages $TR_2$ and $TR_4$ are activated, a reduced power is supplied to this motor.

An end position monitoring circuit contains three functions unit, of which the first unit FCA is connected to the forward logic LA, the memory $M_1$ as well as to a time element $T_2$, the second unit FCR to the backward logic LR, and finally the third unit FCL on the one hand to the control logic LE for the electric motors 29 that rotate the seat 27, and on the other hand, via a time element $T_3$ and an amplifier stage $TR_S$, to a standard-coil (solenoid) SOL. Between the control logic LE and the electric motors 29, a further amplifier stage TRL is arranged. On the input side the control logic LE is connected to the time element $T_2$, the memories $M_1$, $M_2$, the circuit containing the two switches 38, 39, and on the output side to the forward and backward logic LA, LR. The output of the time element $T_3$ is, furthermore, connected to the backward logic LR.

The circuit containing the two switches 38, 39 is connected to the two memories $M_1$, $M_2$, as well as to the backward logic LR and the control logic LE.

The mode of functioning of this control arrangement in the interaction with the device described with reference to FIG. 1 to 4, is as follows:

When the lever 2 of the flushing water cistern 1 is actuated, the valve 4 is opened and the water flows through the flushing water pipe 15 into the toilet bowl 32. The float 6 sinks down, as a result of which, via the lever 6', the valve 7 is opened. Water then flows through the feed pipe 12 of the turbine 11 and drives the latter. As a result thereof the low-voltage directcurrent generator 13 produces a voltage as indicated right at the top of FIG. 11. This Figure also shows other voltage curves of interest in this connection, which occur within the arrangement during normal operation. The same reference symbols are used here as in FIG. 10.

When the control operation is initiated, the time elements $T_1$ and $T_4$ are put into operation. By way of the amplifier stage $TR_1$, the electric motor 19 is made to bring the slide housing 26 into the operating position above the seat 27. A fraction of a second after this operation commences, the function FCR (monitoring the movement of the slide housing 26 in the backward direction) starts. When the time element $T_4$ has run down, the slide housing 26 lies directly above the seat 27, subsequent to which the electric motor 19 is supplied, via the amplifier stage $TR_2$ and a resistor $R_1$, with reduced power, so that the placing of the slide housing 26 onto the seat 27 and the further inward movement of the slide housing 26 take place as gently as possible. This reduced power supply to the motor 19 is also maintained during the rotating of the seat, so that the wiper 48 will all the time be pressed onto the seat 27 with a specific force. As soon as the slide housing 26 has reached its operating position above the seat 27, the function FCA (monitoring the movement of the slide housing 26 in the forward direction) is de-activated, which results in the setting of the time element $T_2$, whereafter the rotating of the seat 27 starts up. To this end, via the control logic LE and the amplifier stage TRL, the two electric motors 29 are made to rotate the seat 27 by 360 degrees. On completing the rotation, the previously switched-on monitoring function FCL is set back again, whereupon the motors 29 are switched off and the time element $T_3$ is set. While the time element $T_3$ runs down, the voltage at the generator 13 may increase to a value which causes the coil SOL to release the lever 62 of the wiper 48''. This is ensured at the end of the interval $T_3$ by the amplifier stage $TR_S$. Hereupon the polarity of the voltage supplied to the motor 19 is reversed, and the slide housing 26—as described in the foregoing for the moving into the operating position—by a switching on of the power stage TRA by the time element $T_4$, is again returned into its neutral position at two different speeds. On reaching the neutral position, the function FCR is set back and the power supply to the motor 19 is interrupted. The described operation can only start up again when the generator 13, after the standstill, is again put into operation by actuating the lever 2.

If at the time of initiating the control operation by a circuit arrangement shown in FIG. 10, at least one of the two switches 38 and 39 respectively (FIG. 2) is open, the control operation cannot commence. However, if the switches 38, 39 close before the internal $T_1$ has expired, the operation will take place normally.

In case of the two switches 38, 39 opens after the control operation has already commenced, the following modified course of events will take place:

If one of the two switches 38, 39 opens while the slide housing 26 moves in the direction of the seat 27, but before the rotating movement of the seat 27 has started, the slide housing 26 will return to the neutral position. If one of the two switches 38, 39 opens before the time element $T_1$ has run down, the described operations will take place as described above; however, if one of the two switches 38, 39 opens after the time element $T_1$ has run down, the cleaning operation for this phase of the filling of the flushing water reservoir 1 will be prevented, since the time required for the cleaning no longer suffices.

If one of the two switches 38, 39 is opened during the rotating movement of the seat 27, the rotating movement will be interrupted, and the slide housing 26 moves back into the neutral position. If one of the two switches 38, 39 opens during the moving back of the slide housing 26 into its neutral position, this will not affect the backward movement. If a voltage drop should occur during the described course of events, these events will be interrupted and will only be ended after the lever 2 has been actuated once again.

The method and device according to the invention are suitable for new installations as well as for adaptation to existing toilets. The turbine drive of the low-voltage direct-current generator 13 is an expedient solution, which is independent of the main supply. As indicated in the foregoing, if a lowvoltage source is available, this may be used to drive the control electronics 17 and the electric motors 19, 29, thus complying with all conceivable safety requirements.

The subject of the invention constitutes an important step forward in social hygiene, without resulting in environmental pollution.

What is claimed is:

1. A method for the automatic cleaning of a substantially ring-shaped toilet seat, said method comprising the steps of:

providing a toilet bowl operably connected to a flush water cistern, said toilet bowl having a substantially ring-shaped toilet seat rotatably mounted thereon, said toilet seat being rotatable in a circumferential direction, said flush water cistern being connected to a water valve means for controlling the flow of water through said water inlet pipe to maintain a predetermined water level in said flush water cistern, said toilet bowl operably connected to said flush water cistern through a lever-actuated second valve means for controlling the flow of water from said flush water cistern to said toilet bowl, said lever-actuated second valve means including a manually actuable lever movable between a valve closed position and a valve open position;

providing a slide housing means slidingly moveable between a neutral position adjacent said toilet seat and an operative position disposed above a segment of said toilet seat, for housing spray means for applying a cleaning liquid to said toilet seat when said slide housing means is in said operative position and drying means for drying said toilet seat after application of said cleaning liquid;

providing first motor means, responsive to a first power input, for moving said slide housing means between said neutral position and said operative position;

providing second motor means, responsive to a second power input, for rotaitng said toilet seat in said circumferential direction;

providing a power supply means, responsive to actuation of said manually actuable lever, for providing power to said first motor means and said second motor means;

providing control electronics means, operably connected to said first motor means, said second motor means and said power supply means, for controlling the distribution of power from said power supply means to said first motor means and said second motor means;

moving said manually actuable lever from said valve closed position to said valve open position whereby said water in said flush water cistern through said water inlet pipe and said power supply means provides power and said control electronics means automatically causes said first motor means to move said slide housing means from said neutral position into said operative position and said spray means applies said cleaning liquid to said toilet seat, while also causing said second motor means to rotate said toilet seat through at least 360°0 C. while said drying means dries said toilet seat after application of said cleaning liquid.

2. The method according to claim 1, wherein said spray means includes third valve means for controlling the application of said cleaning fluid to said toilet seat, said third valve means responsive to the position of said slide housing so as to be open when said slide housing is in said operative position and to be closed when said slide housing is in said neutral position.

3. The method according to claim 1, wherein said first motor means comprises a first electric motor and said second motor means comprises a second electric motor.

4. The method according to claim 3, wherein said power supply means comprises a turbine drivingly connected to an electrical power generator, said turbine being supportingly connected to said water inlet pipe and driven by water flowing into said flush water cistern through said water inlet pipe.

5. The method according to claim 4, wherein said spray means includes third valve means for controlling the application of said cleaning liquid to said toilet seat, said third valve means operably connected to said control electronics means and controlled thereby.

6. The method according to claim 4, further comprising providing sensor means for detecting whether said toilet seat is occupied, said sensor means operably connected to said control electronics means to prevent actuation thereof during seat occupancy.

7. The method according to claim 1, wherein said drying means comprises at least one first wiper extending substantially radially relative to said toilet seat and at least one second wiper extending substantially circumferentially relative to said toilet seat whereby said at least one first wiper wipes said toilet seat when said slide housing is in said operable position and said toilet seat is rotated by said second motor means and said at least one second wiper wipes said toilet seat when said slide housing is moved from said operative position to said neutral position by said first motor means.

8. The method according to claim 7, wherein said at least one second wiper comprises a single wiper fastened to a tiltable lever, said tiltable lever pivotally connected to said slide housing, said tiltable lever and hence said single wiper movable between an upper position wherein said single wiper is free of said toilet seat and a lower position wherein said single wiper is engageable of said toilet seat, a solenoid mounted on said slide housing engaging said titable lever to hold said tiltable lever in said upper position when said slide housing is in said operative position and releasing said tiltable lever to allow said single wiper to engage said toilet seat when said slide housing moves from said operative position to said neutral position.

9. The method according to claim 1, wherein said drying means comprises means for directing a stream of dry air onto said toilet seat.

10. A toilet with an automatically cleanable toilet seat comprising:

a toilet bowl;

a flush water cistern;

a substantially ring-shaped toilet seat, said toilet seat being rotatable in a circumferential direction;

mounting means for mounting said toilet seat on said toilet bowl for relative rotation therebetwen in said circumferential direction;

a water inlet pipe, connected to said flush water cistern, for supplying water to said flush water cistern;

first valve means, connected to said water inlet pipe, for controlling the flow of water through said water inlet pipe to maintain a predetermined water level in said flush water cistern;

lever-actuated second valve means for fluidically connecting said toilet bowl and said flush water cistern and for controlling the flow of water from said flush water cistern to said toilet bowl, said lever-actuated second valve means including a manually actuable lever movable between a valve closed position and a valve open position;

a slide housing means slidingly movable between a neutral position adjacent said toilet seat and an operative position disposed above a segment of said toilet seat, for housing spray means for applying a cleaning liquid to said toilet seat when said slide housing means is in said operative position and drying means for drying said toilet seat after application of said cleaning liquid;

first motor means, responsive to a power input, for moving said slide housing means between said neutral position and said operative position;

second motor means, responsive to a power input, for rotating said toilet seat in said circumferential direction, relative to said toilet bowl;

power supply means, responsive to actuation of said manually actuable lever, for providing power to said first motor means and said second motor means;

control electronics means, operably connected to said first motor means, said second motor means and said power supply means, for controlling the distribution of power from said power supply means to said first motor means and said second motor means;

whereby upon movement of said manually actuable lever from said valve closed position to said valve open position, said water in said flush water cistern is released into said toilet bowl and said first valve means opens to allow water to flow into said flush water cistern through said water inlet pipe and said power supply means provides power to said control electronics means and said control electronics means causes said first motor means to move said slide housing means from said neutral position into said operative position and said spray means applies said cleaning liquid to said toilet seat, while also causing said second motor means to rotate said toilet seat through at least 360° while said drying means dries said toilet seat after application of said cleaning liquid.

11. The toilet according to claim 10, wherein said spray means includes tank means for containing said cleaning liquid.

12. The toilet according to claim 10, wherein said mounting means comprises a compressable elastic ring connected to said toilet bowl and a plurality of rotatable steel balls connected to a bottom surface of said toilet seat, said compressible elastic ring engagingly receivable of said plurality of steel balls.

13. The toilet according to claim 10, wherein said spray means comprises a sponge insert member covered with a liquid-permeable material cover engagingly contactable with said toilet seat when said slide housing means is in said operative position, said sponge insert being fluidically connected to a source of cleaning liquid and permeated with cleaning liquid therefrom.

14. The toilet according to claim 10, wherein said control electronics means includes first motor control means for connecting said power supply means to said first motor means comprising: forward logic means for controlling said first motor means to move said slide housing means from said neutral position to said operative position; forward power stage means, operably connected to said forward logic means, for controlling the amount of power supplied to said first motor means; backward logic means for controlling said first motor means to move said slide housing from said operative position to said neutral position; and backward power stage means, operably connected to said backward logic means, for controlling the amount of power supplied to said first motor means.

15. The toilet according to claim 14, wherein said forward power stage means comprises a first forward sub- stage for supplying full power to said first motor means and a second forward substage for supplying partial power to said first motor means; and said backward power stage means comprises a first backward substage for supplying full power to said first motor means and a second backward substage for supplying partial power to said first motor means.

16. The toilet according to claim 10, wherein said control electronics means includes second motor control means for connecting said power supply means to said second motor means, said second motor means comprising: control logic means for controlling said second motor means to cause the rotation of said toilet seat; and amplifier stage means, operably connected to said control logic means, for controlling the amount of power supplied to said second motor means.

17. In a method for automatically cleaning a toilet seat, wherein said toilet seat, during said cleaning, is moved in a circumferential direction, and is cleaned with a cleaning liquid, the improvement comprising providing slide housing means for housing means for applying said cleaning liquid to said toilet seat and drying means for drying said toilet seat, said slide housing means being slidingly movable from a neutral position outside said toilet seat to an operative position above a segment of said toilet seat, said cleaning liquid being applied to said toilet seat when said slide housing means is in said operative position, said toilet seat being rotatable by at least 360°, to facilitate cleaning and drying of said toilet seat.

18. A method according to claim 17, wherein said slide housing means is slidingly movable between said neutral position and said operative position in a generally horizontal direction.

19. A device suitable for automatically cleaning a substantially ring-shaped toilet seat, comprising:

mounting means for mounting said toilet seat on a toilet bowl for relative rotation therebetween in a circumferential direction;

spray means for applying a cleaning liquid to said toilet seat;

slide housing means for housing said spray means, said slide housing means being slidingly movable between a neutral position adjacent said toilet seat and an operative position disposed above a segment of said toilet seat, said cleaning liquid beign sprayable by said spray means onto said toilet seat when said slide housing means is in said operative position;

drying means for drying said toilet seat after application of said cleaning liquid;

first motor means, responsive to a power input, for moving said slide housing means between said neutral position and said operative position;

second motor means, responsive to a power input, for rotating said toilet seat in said circumferential direction, relative to said toilet bowl;

power supply means, responsive to actuation of a manually actuable lever, for providing power to said first motor means and said second motor means;

control electronics means, operably connected to said first motor means, said second motor means and said power supply means, for controlling the distribution of power from said power supply means to said first motor means and said second motor means, actuation of said power supply means providing power to said control electronics means to cause said first motor means to slidingly move said slide housing means from said neutral position into said operative position and said spray means to apply said cleaning liquid to said toilet seat, while also causing said second motor means to rotate said toilet seat through at least 360° while said drying means dries said toilet seat after application of said cleaning liquid.

20. A device according to claim 19, wherein said slide housing means is positioned slidingly on slide rails, and is urged towards said neutral position by a helical spring.

21. A device according to claim 19, wherein said slide housing means includes support roller

* * * * *